US005794540A

United States Patent [19]

Dombrowski et al.

[11] Patent Number: 5,794,540

[45] Date of Patent: Aug. 18, 1998

[54] CHILD'S EASEL/TABLE

[75] Inventors: David Dombrowski; Kenneth Von Felten, both of East Aurora, N.Y.

[73] Assignee: Fisher-Price Inc., Aurora, N.Y.

[21] Appl. No.: 698,996

[22] Filed: Aug. 16, 1996

[51] Int. Cl.[6] ..... A47F 5/12

[52] U.S. Cl. ..... 108/3; 108/11; 108/172

[58] Field of Search ..... 108/6, 17, 13, 108/11, 168, 170, 167, 169, 230, 171, 172, 3; 312/231

[56] References Cited

U.S. PATENT DOCUMENTS

| | | | |
|---|---|---|---|
| D. 330,573 | 10/1992 | Monneret . | |
| D. 350,239 | 9/1994 | Swanger . | |
| D. 354,400 | 1/1995 | Cacciola . | |
| D. 355,682 | 2/1995 | Bro et al. . | |
| D. 358,434 | 5/1995 | Brown et al. . | |
| D. 367,568 | 3/1996 | Strayer . | |
| D. 368,189 | 3/1996 | Bro et al. . | |
| D. 368,281 | 3/1996 | Brown et al. . | |
| 1,170,326 | 2/1916 | Posivak | 108/172 |
| 4,117,781 | 10/1978 | Middleton et al. . | |
| 4,244,632 | 1/1981 | Molinari . | |
| 4,262,606 | 4/1981 | Hodson . | |
| 4,427,391 | 1/1984 | Berman . | |
| 4,735,466 | 4/1988 | Wolters et al. . | |
| 4,735,469 | 4/1988 | Liggett . | |
| 4,766,422 | 8/1988 | Wolters . | |
| 4,791,873 | 12/1988 | Towfigh . | |
| 4,856,856 | 8/1989 | Winstone . | |
| 5,074,221 | 12/1991 | Lochridge . | |
| 5,088,802 | 2/1992 | House . | |
| 5,167,394 | 12/1992 | Hegarty . | |
| 5,244,267 | 9/1993 | Fossier, Jr. et al. . | |
| 5,244,271 | 9/1993 | Hackwood et al. . | |
| 5,330,248 | 7/1994 | Smyly et al. . | |
| 5,348,263 | 9/1994 | Hubbard . | |
| 5,360,342 | 11/1994 | Pardner . | |
| 5,393,030 | 2/1995 | Tarozzi . | |
| 5,438,938 | 8/1995 | Meeker et al. | 108/159 |

*Primary Examiner*—Peter M. Cuomo
*Assistant Examiner*—Gerald A. Anderson
*Attorney, Agent, or Firm*—Morgan, Lewis & Bockius LLP; C. Scott Talbot; Michele Van Patten Frank

[57] ABSTRACT

An article of children's furniture is convertible between a table configuration and an easel configuration. The article of furniture comprises a support member, a work surface, and a handle coupled to the work surface for changing the configuration of the article. The work surface includes a pair of panels that are attached to each other by a hinge, the handle being attached to the panels at the hinge. The handle includes a locking portion for engaging the support member to lock the work surface to the support member in the table configuration. The article is convertible to the easel configuration by rotating the handle to unlock the work surface from the support member and lifting both panels to the easel configuration. A lever lock is coupled to the support member for locking the panels in the easel configuration. The article is convertible to the easel configuration by depressing the lever lock to release the panels, which are then spread apart and lowered onto the support member. The panel is positioned on the support member and the handle is rotated to the locked position

27 Claims, 13 Drawing Sheets

CHILD'S EASEL/TABLE

The present invention relates generally to children's furntiture. More particularly, the invention relates to a piece of children's furniture that is convertible between a table and an easel, especially a double easel.

BACKGROUND OF THE INVENTION

Children's tables and easels are well known in the art, as are tables that are convertible to easels. Typically, these convertible tables include a support structure and a panel that cooperates with the support structure to form a table top or an easel surface, depending on the orientation of the panel. The panel generally sits in a recess to form the table configuration and can be lifted out of the recess and relocated into slots to form the easel configuration. However, conventional tables do not have provisions for locking the panel to the support structure in the table top or easel configurations. Thus, it is possible for a child to reconfigure the easel/table without adult supervision, which is generally undesirable, especially if the child is using paints or other liquids that could spill during the reconfiguration process. Accordingly, a locking feature that would restrict reconfiguration to an adult or an older child would be very useful.

While a locking feature is useful and desirable, it must be easy to use. In particular, there are times when a supervising adult may want to reconfigure the table for the child, but can only use one hand. Accordingly, a preferred locking feature would employ a simple operation and still be capable of single handed operation.

SUMMARY OF THE INVENTION

According to the present invention, an article of children's furniture comprises a support member, a work surface, and a handle coupled to the work surface for changing the configuration of the article of furniture between an easel configuration and a table configuration.

The support surface includes a center tray that has a central eliptical aperture. The support surface also has a plurality of indexing projections for engaging the work surface to align the work surface in the table configuration.

The work surface includes a pair of panels having indentations for receiving the indexing projections. The panels are attached to each other by a hinge, and the handle is attached to the panels at the hinge.

The handle includes a pair of orthogonal hinge receiving holes extending therethrough, and a pair of opposed slots extending outwardly from the center of the handle and between the holes. The holes and slots cooperate to allow the handle to rotate 90 degrees about its longitudinal axis while remaining coupled to the hinge. The handle also includes an eliptical locking portion.

When the panels are in the table configuration, the indexing projections are disposed in the panel indentations and the eliptical locking portion is positioned in the eliptical aperture formed in the support member. The handle is rotated about its longitudinal axis so that the major axis of the locking portion is orthogonal to the major axis of the aperture to lock the panels to the support member. To convert the table to the easel configuration, the handle is rotated 90 degrees in the opposite direction to align the major axes of the locking portion and the aperture to unlock the panels from the support surface, and both panels are lifted by the handle to the easel configuration. A lever lock is coupled to the support member for locking the panels in the easel configuration.

To convert from the easel configuration to the table configuration, the lever lock is released and the panels are spread apart and lowered onto the support member. The panel is positioned to align the indentations with the indexing projections and the handle is rotated about its longitudinal axis to the locked position.

DETAILED DESCRIPTION OF THE DRAWINGS

Figure 1:
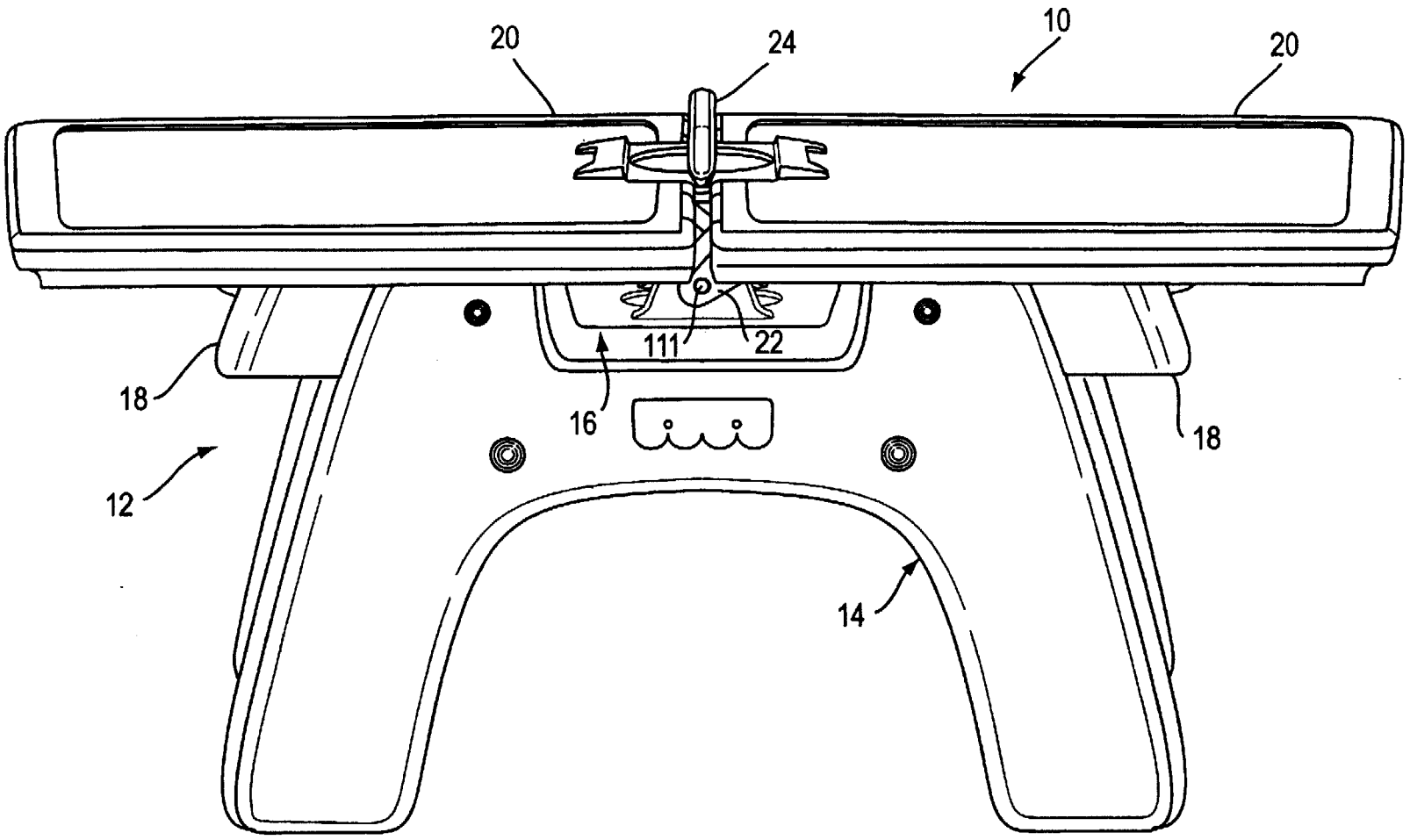
FIG. 1 is an isometric view of an article of furniture in a table configuration.
Figure 2:
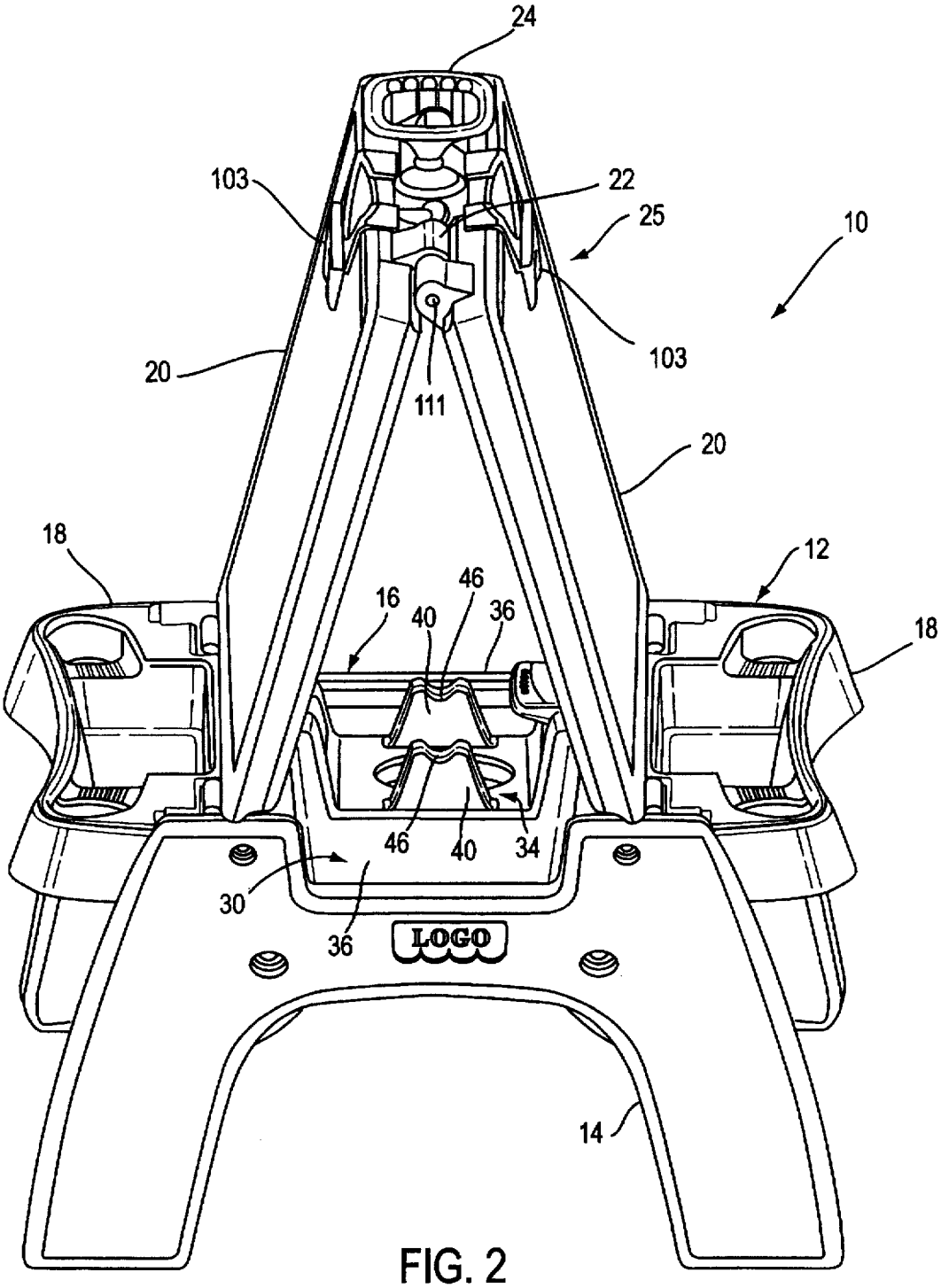
FIG. 2 is an isometric view of the article of furniture of FIG. 1 in an easel configuration.

An article of furniture 10, convertible between a table configuration and an easel configuration, is illustrated generally in FIGS. 1–2. The easel/table 10 includes a support member 12 and a pair of panels 20. The panels 20 are connected by a hinge 22 and provide a table surface (FIG. 1) or easel surface (FIG. 2), depending on the orientation. A handle 24 is attached to the hinge 22, forming a panel/handle assembly 25 that permits simultaneous movement of both panels 20 from the support member 12 in a one-handed operation.

The support member 12 comprises a pair of leg assemblies 14, a center tray 16, and a pair of paint trays 18. The leg assemblies 14 and the paint trays 18 are securely attached to the center tray 16. However, the paint trays 18 are preferably easily removed and replaced for cleaning.

Figure 3:
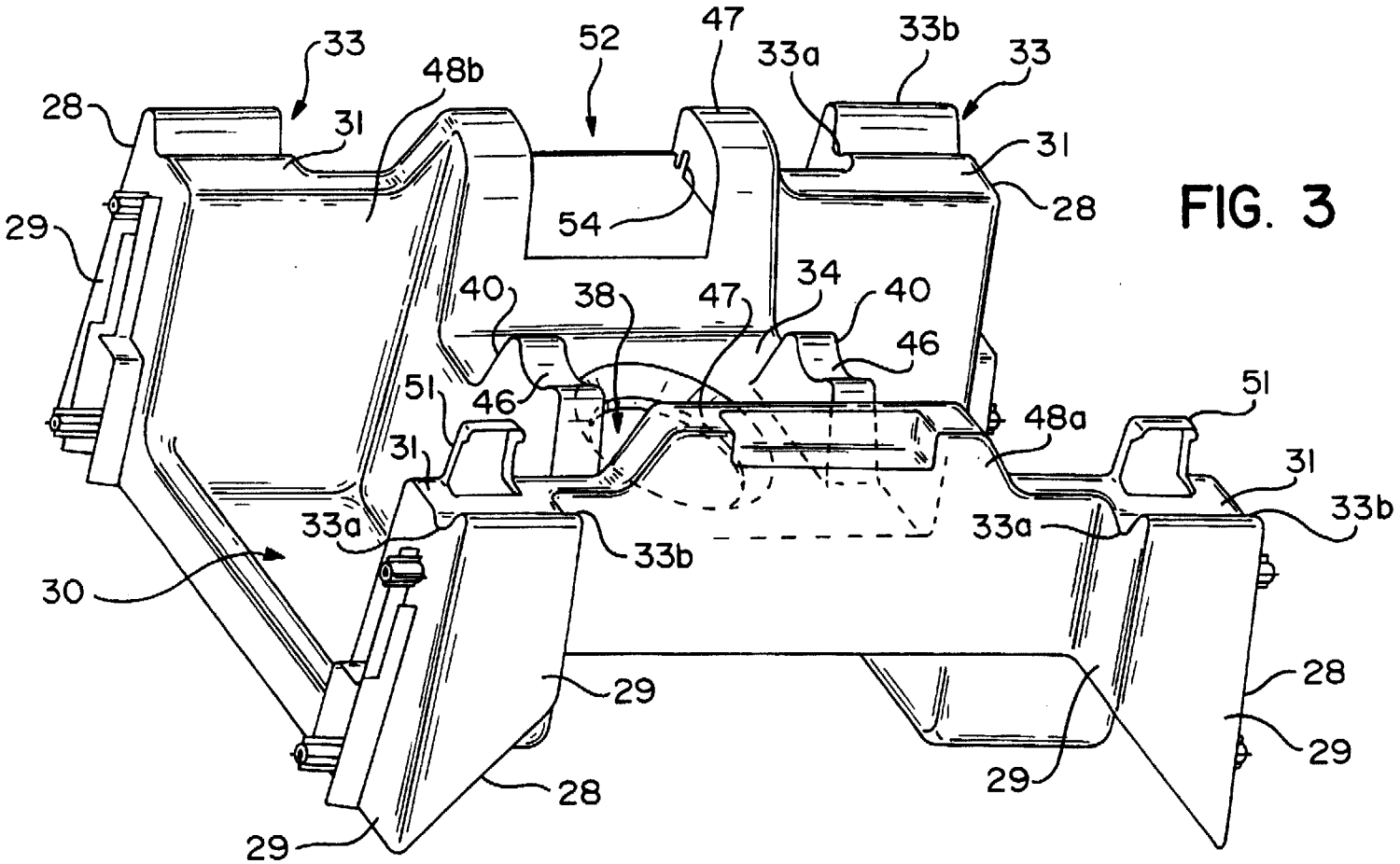
FIG. 3 is an isometric view of the center tray of the article of furniture of FIGS. 1–2.

The center tray 16, illustrated in FIG. 3, includes a pair of side storage compartments 30 that are disposed on either side of a raised central platform 34. The raised central platform 34 includes a central eliptical aperture 38 and a pair of generally M-shaped ridges 40 positioned adjacent the eliptical aperture 38 and extending parallel to the major axis thereof. Each ridge 40 is formed to include a recess 46 for receiving the hinge 22 when the panels 20 are in the table configuration. The side compartments 30 are positioned adjacent the leg assemblies 14.

A leg-engaging member 28 extends outwardly from each corner of the center tray 16, with each leg-engaging member 28 including a plurality of sidewalls 29 and a top wall 31. One sidewall of each leg engaging member 28 includes a bracket 27 for engaging a leg assembly 14 and the top wall 31 of each member 28 includes a groove 33 for receiving a panel 20 in the easel configuration. The groove 33 is defined by a recess **33*a* disposed adjacent an upwardly extending ridge 33*b***.

A pair of end walls **48*a*, 48*b* extend across the ends of the platform34 orthogonally to the major axis of the eliptical aperture 38. Both end walls 48*a*, 48*b* include a centrally located bulwark 47 extending upwardly from the end wall 48. The bulwarks 47 are sized and positioned to engage and align the panels 20 in the table configuration. End wall 48*a* further includes a pair of generally hook-shaped holding projections 51 for engaging the panel 20 in the easel configuration and providing additional alignment for the panels 20 in the table configuration. Each wall 48*b* includes a cut-out 52 that has a pivot pin receiving aperture 54 in each side wall of the cut-out 52 for receiving a lever lock 56**.

Figure 4:
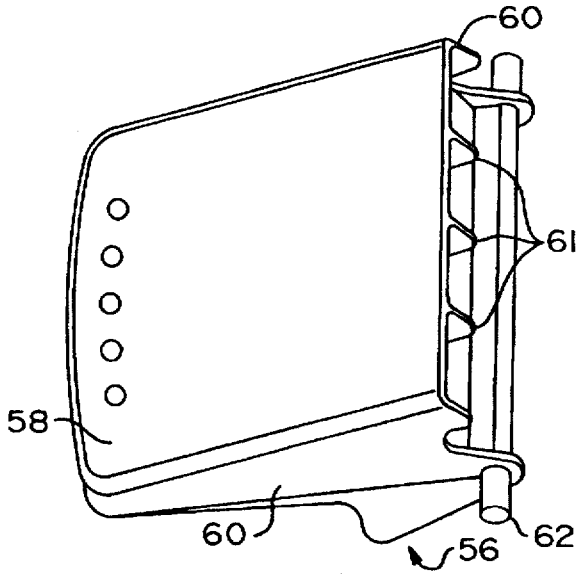
FIG. 4 is an isometric view of a lever lock.
Figure 5:
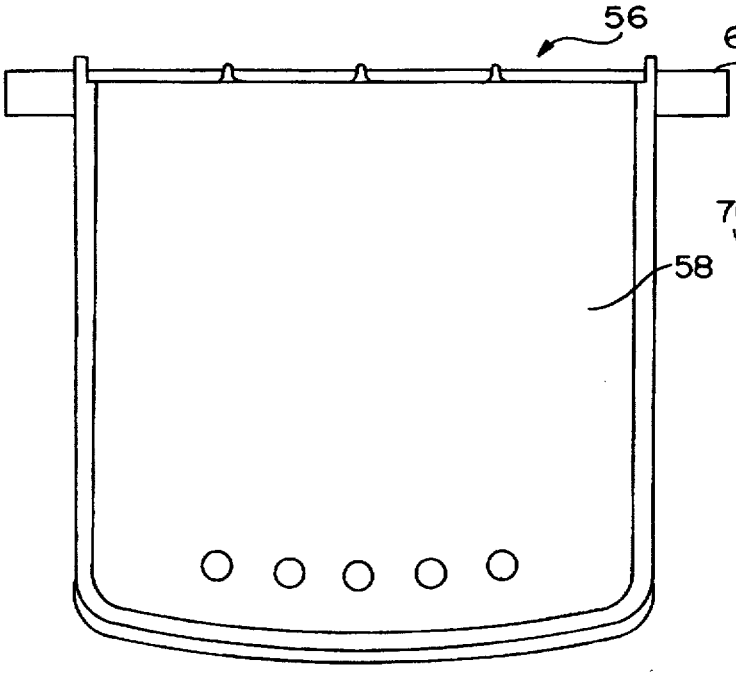
FIG. 5 is a top view of the lever lock.
Figure 6:
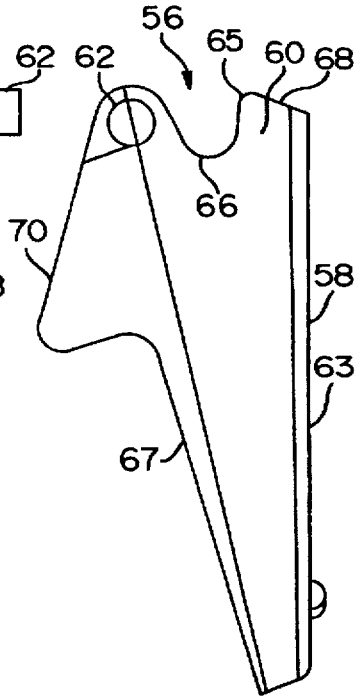
FIG. 6 is a left side view of the lever lock of FIG. 5.
Figure 7:
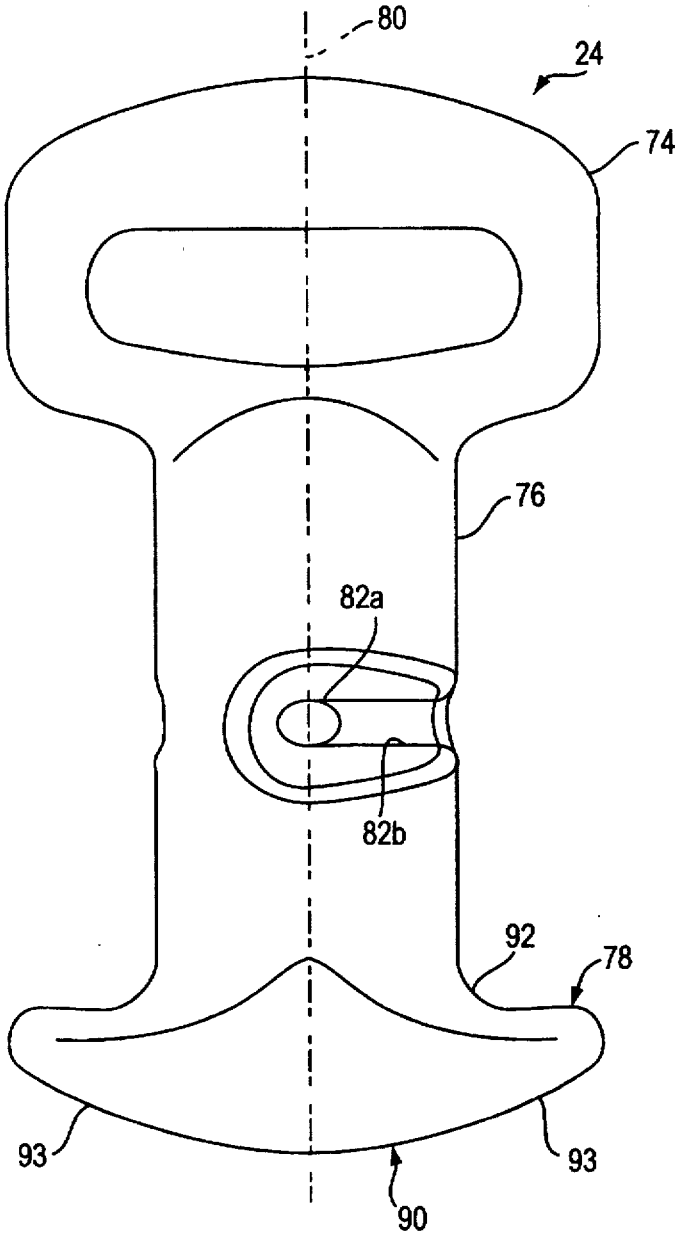
FIG. 7 is a front view of a handle as illustrated in FIGS. 1–2.
Figure 8:
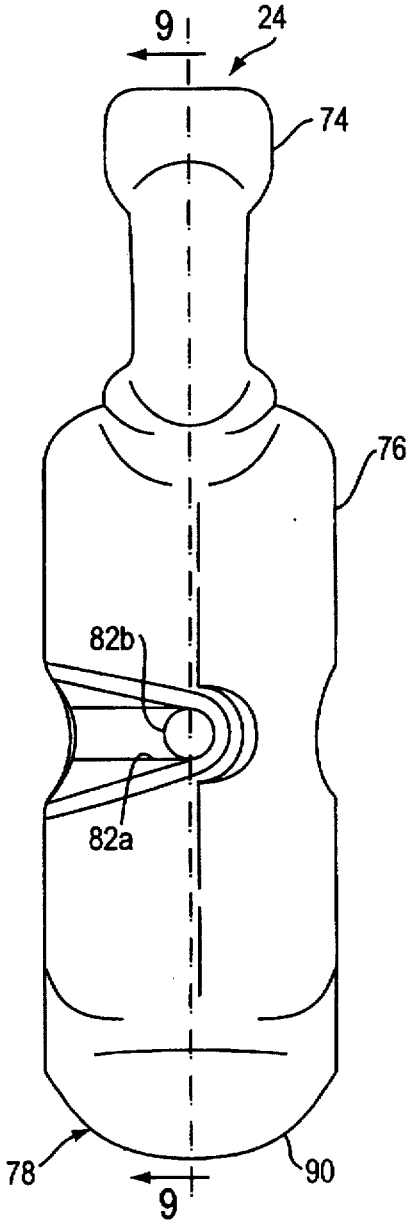
FIG. 8 is a left side view of the handle of FIG. 7.
Figure 9:
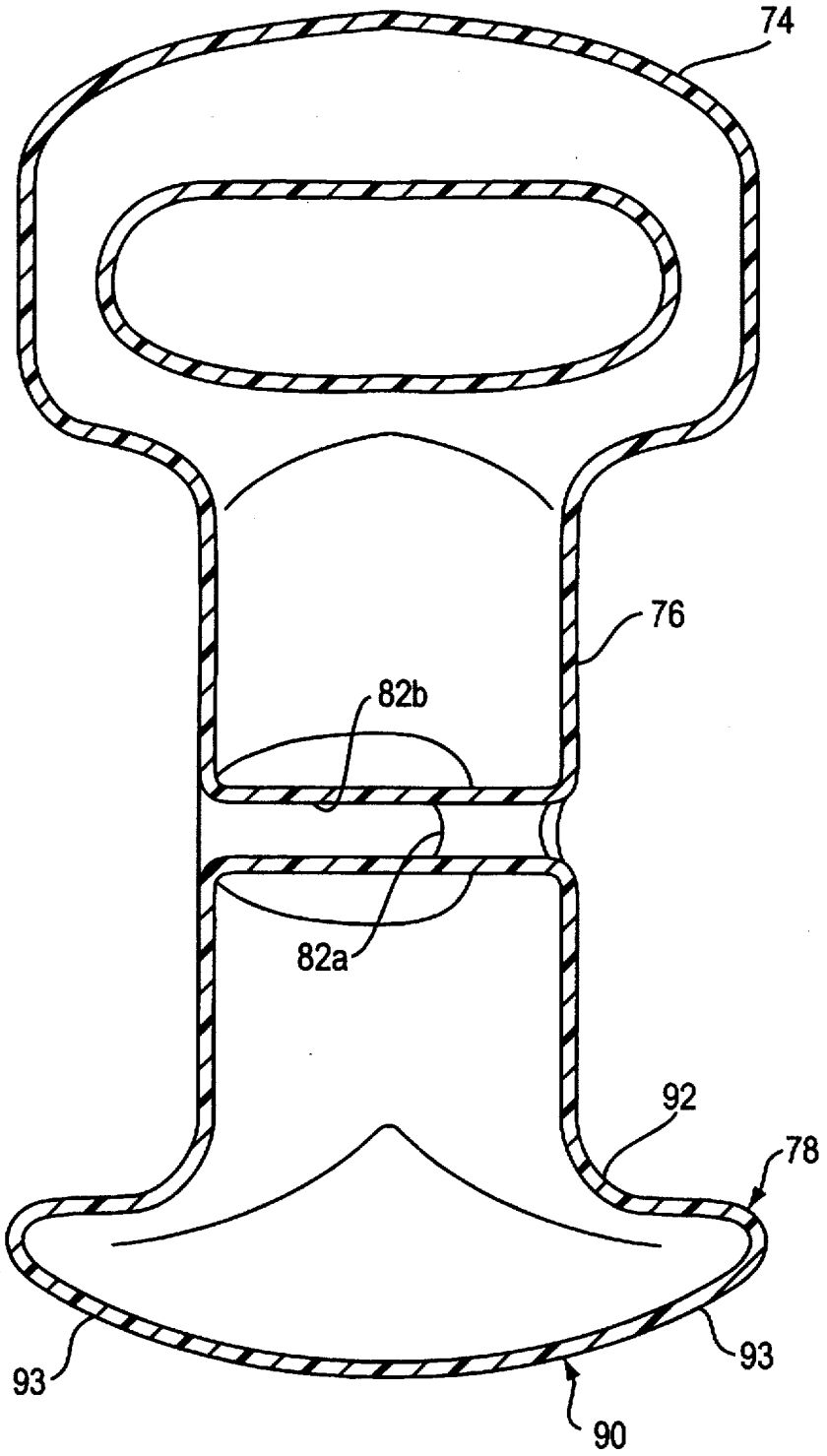
FIG. 9 is a section view taken along line 9—9 of FIG. 8.
Figure 10:
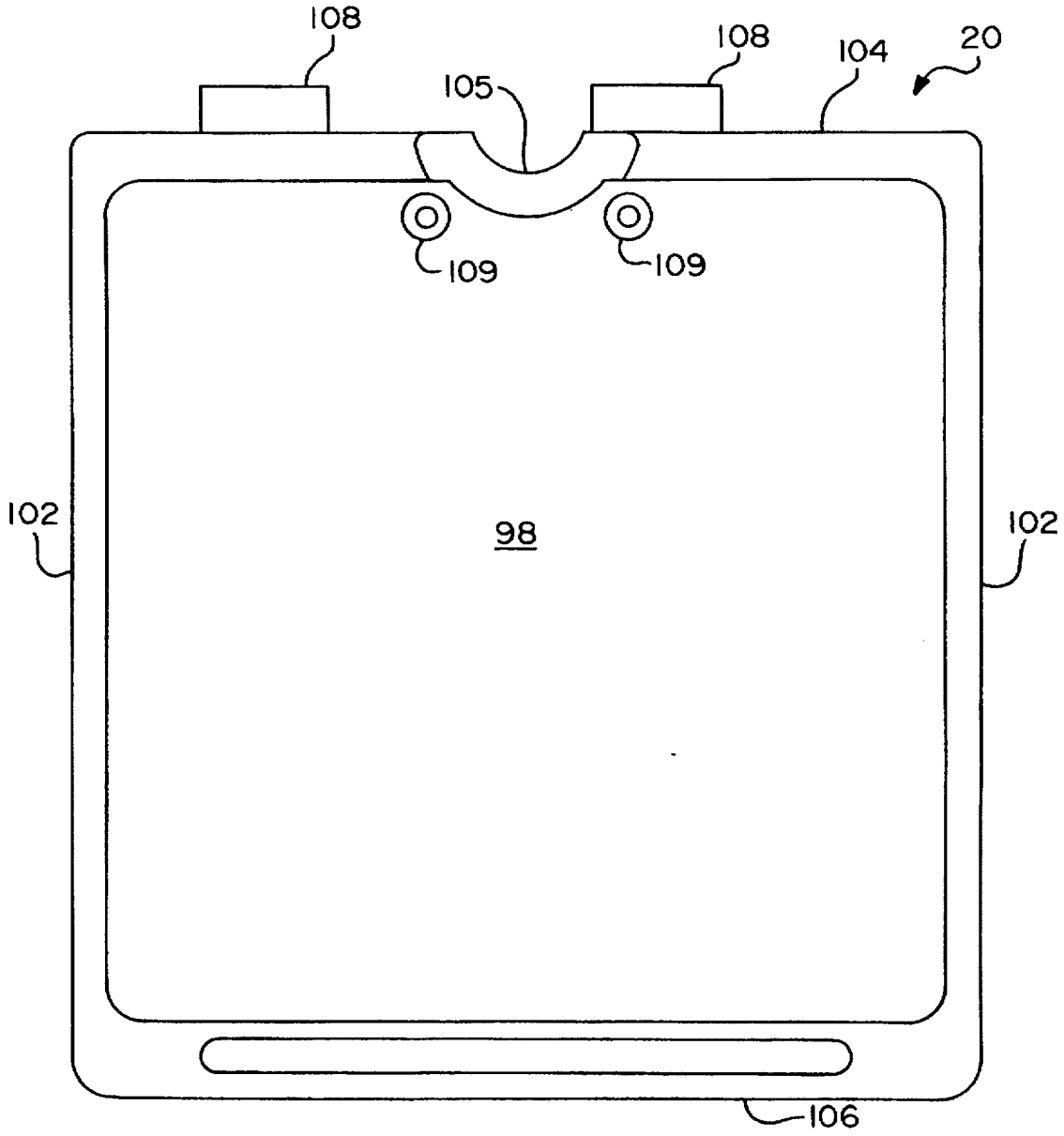
FIG. 10 is a front view of a panel.
Figure 11:
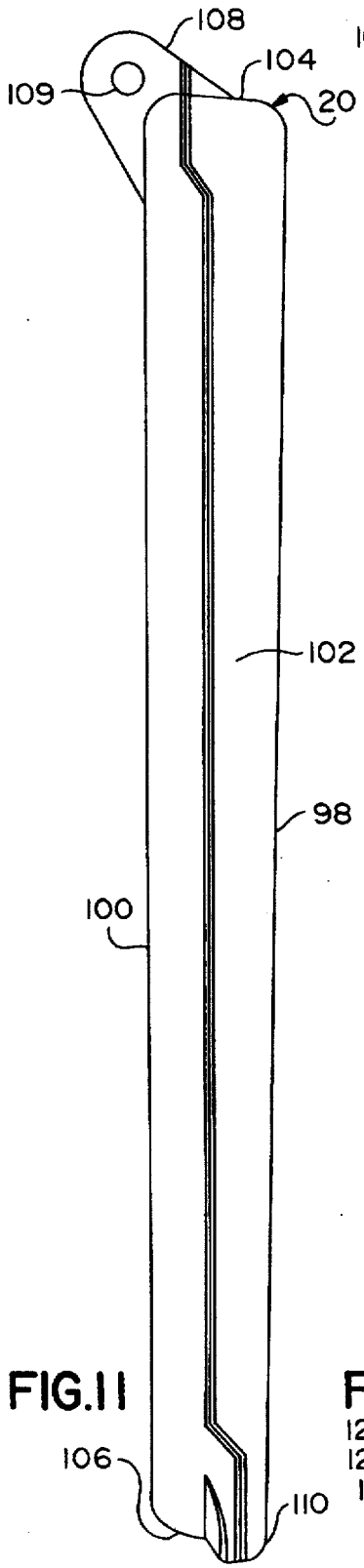
FIG. 11 is a side view of the panel of FIG. 10.
Figure 18:
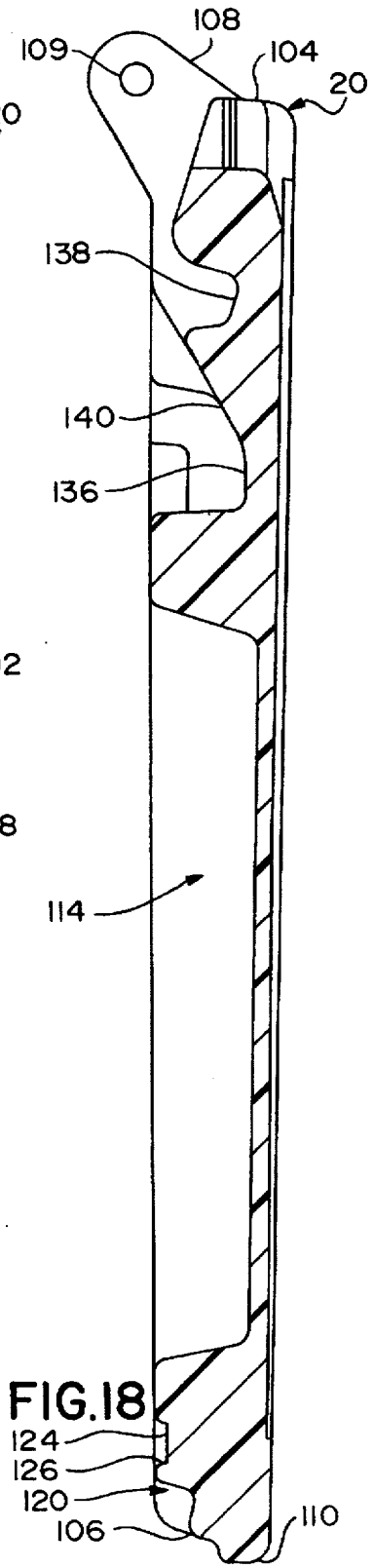
FIG. 18 is a section taken along lines 18—18 in FIG. 17.
Figure 19:
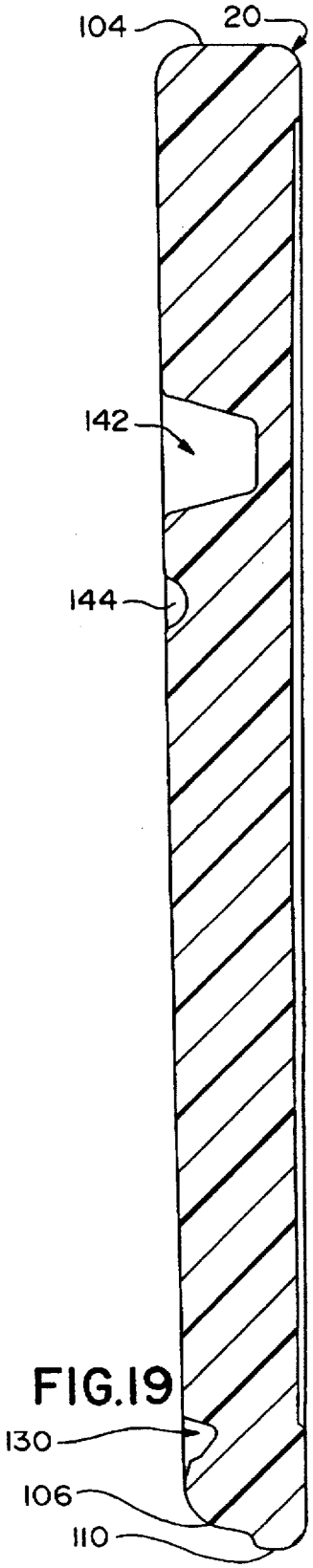
FIG. 19 is a section taken along lines 19—19 in FIG. 17.

The lever lock 56, illustrated in FIGS. 4–6, includes a generally rectangular planar member 58, a pair of side walls 60 depending downwardly therefrom, and a plurality of stiffening ribs 61 in parallel, spaced-apart relation with the side walls 60. A pivot pin 62 extends outwardlly from each side wall 60 and engages one of the pivot pin receiving apertures 54 to pivotally couple the lever lock 56 to the center tray 16.

As best seen in FIG. 6, each side wall 60 of the lever lock 56 is generally triangular shaped having a first side 63, a second side 65, and a third side 67. The planar member 58 forms a first side 63 of the triangle and the pivot pin 62 is positioned at the apex opposite the first side 63. The second side 65 of the triangle includes a notch 66 for engaging one of the panels 20 to lock the panels 20 in the easel configuration and camming surface 68. The third side 67 of the triangle includes an outwardly projecting triangle 70. The plurality of stiffening members 61 generally conform in shape with the notch 66.

The handle 24 includes a hand grip 74, a cylindrical center portion 76 and an eliptical locking portion 78. The cylindrical center portion 76 includes a longitudinal axis 80 and a pair of orthogonal hinge pin receiving holes **82*a*, 82*b* passing through the axis 80. A pair of slots 84 extend radially outwardly from the longitudinal axis 80 to the perimeter of the cylindrical portion 76 and between the holes 82**.

The locking portion 78 includes an eliptical member 90 having a pair of outwardly extending projections 92. A longitudinal axis of the eliptical member 90 is aligned to lie in the plane of the handgrip 74, so that when the handle 24 is in an unlocking position (FIG. 2), the handgrip 74 and the eliptical member 90 are aligned with the major axis of the eliptical aperture 38. When the handle 24 is rotated 90 degrees from the unlocking position, the longitudinal axis of the eliptical member 90 is orthogonal to the major axis of the eliptical aperture 38.

The eliptical member 90 is sized so that the projections 92 pass through the eliptical aperture 38 when the handle 24 is in the unlocking position. A fillet portion 93 connects the eliptical member 90 to the cylindrical center portion 76 and facilitates rotation of the handle 24 by reducing interference between the edges of the eliptical aperture 38 and the locking portion 78.

The panels 20 are rectangular boxes having a front wall 98 and a back wall 100 held in spaced-apart relation by a pair of side walls 102, a top wall 104 and a bottom wall 106. The top wall 104 includes a semi-circular notch 105 for receiving the handle 24. A pair of hinge knuckles 108 extend from the top wall 104 and are arranged to provide side-by-side placement of alternate hinge knuckles when two panels 20 are operatively positioned (FIG. 2). Each hinge knuckle 108 includes a central bore 109 for receiving a hinge pin 111 (FIGS. 1–2). The bottom wall 106 includes a lip 110 extending outwardly from the panel 20 parallel to the plane of the panel 20 when the panels 20 are in the easel configuration.

The front wall 98 includes a recess 99 capable of receiving a chalkboard 107 or other writing surface, but is otherwise substantially smooth. The front wall 98 also includes a pair of holes 109 for receiving a clip 103.

An exemplary clip 103 is shown in FIGS. 13–16. The clip includes an upper edge 113 with a semi-circular notch 115 that matches the notch 105 in the top wall 104 of the panel. In addition, a pair of bosses 117 extend downwardly from a bottom surface 119 of the clip 103 to be received in the holes 109 in the front wall 98. In operation, the clip 103 includes an overhanging portion 121 that has a rod-receiving region 123 that extends over and above the chalkboard receiving recess 99. The rod 125 is free to move within the region 123 and, under the force of gravity, pinches paper inserted between the rod 125 and the front wall 98. A rectangular cut out 127, allows a user to push the rod 123 upwardly and out of the way to free the paper.

Figure 12:
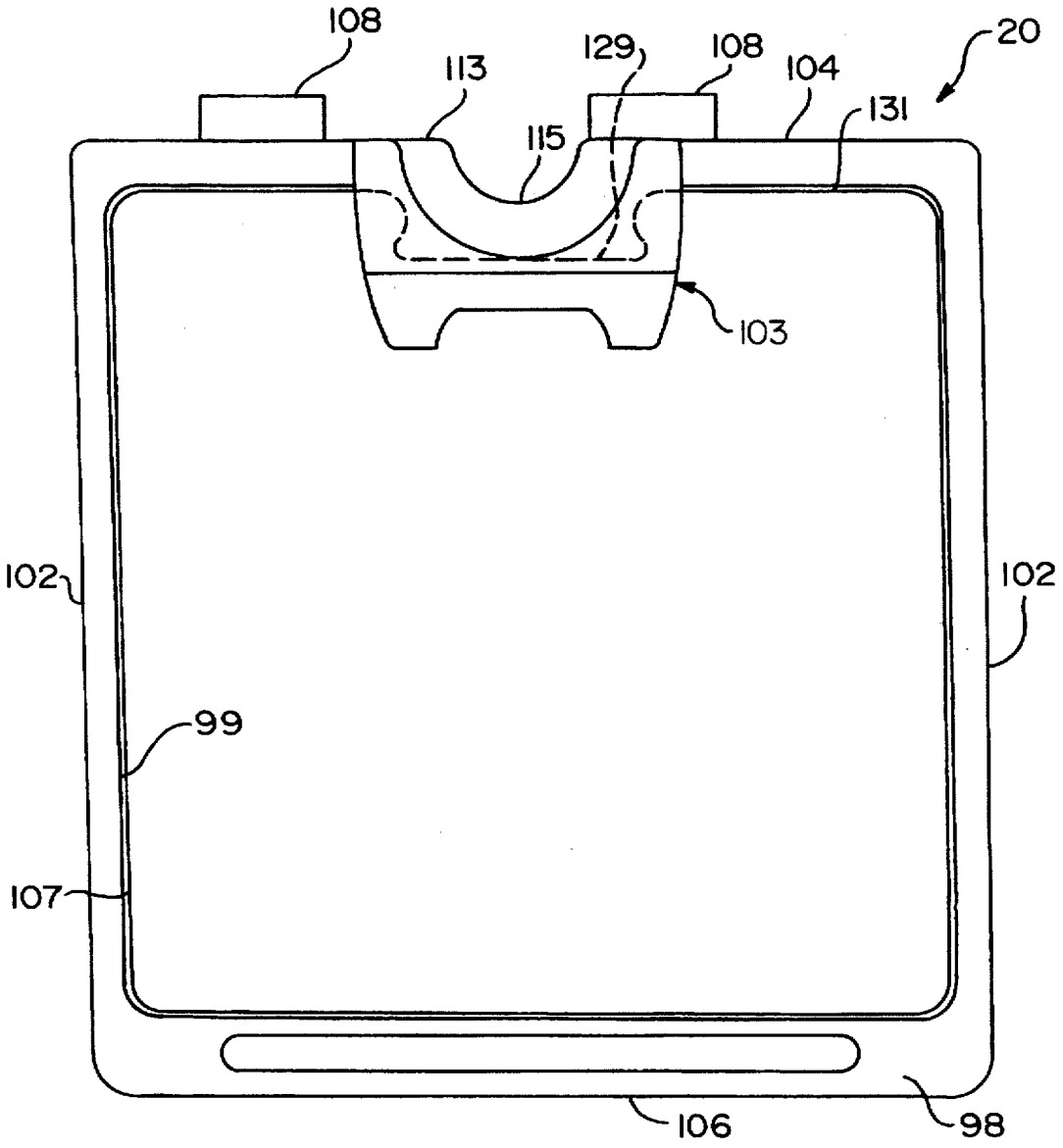
FIG. 12 illustrates a chalkboard installed on a panel.
Figure 13:
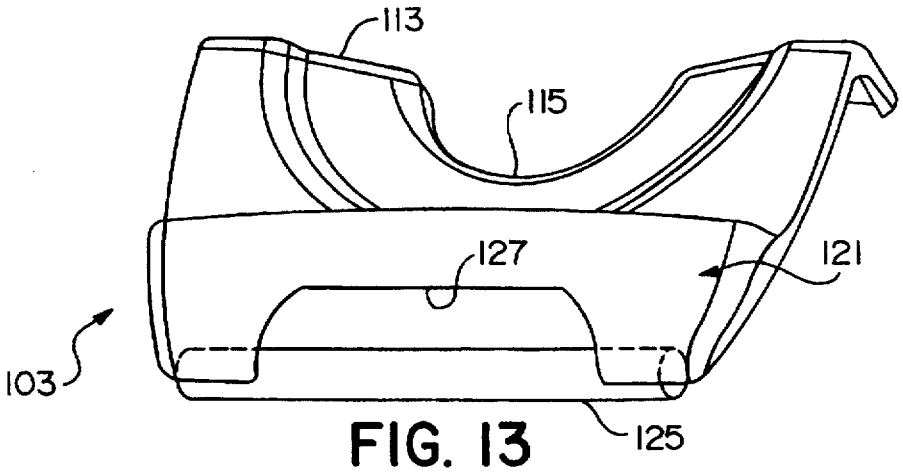
FIG. 13 is a top isometric view of a paper clip for use with the panel of FIG. 10.
Figure 14:
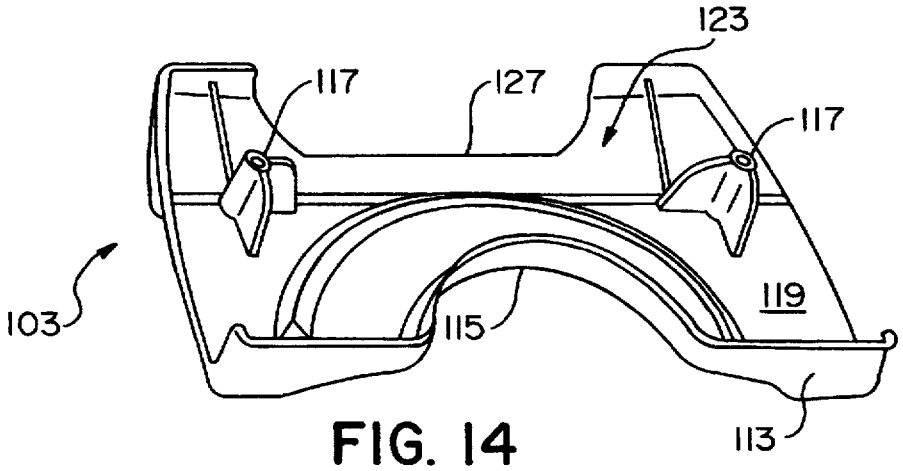
FIG. 14 is a bottom isometric view of the clip of FIG. 13.
Figure 15:
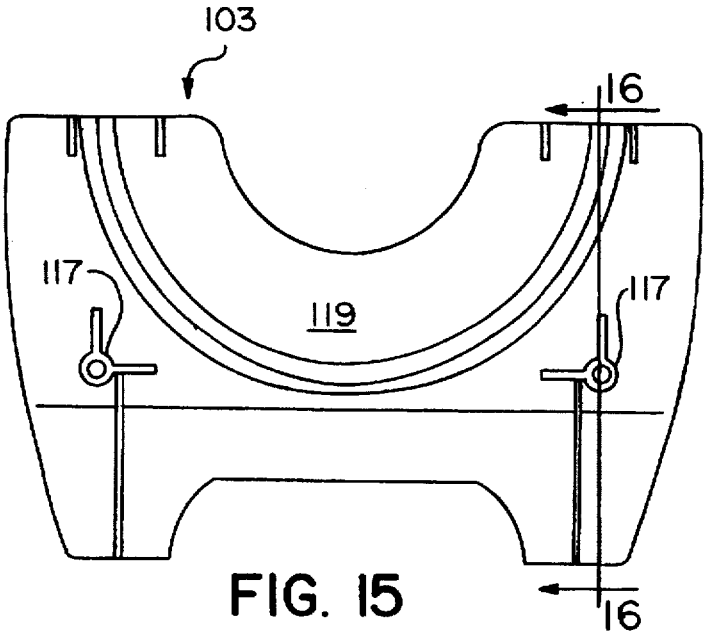
FIG. 15 is a bottom plan view of the clip of FIG. 13.
Figure 16:
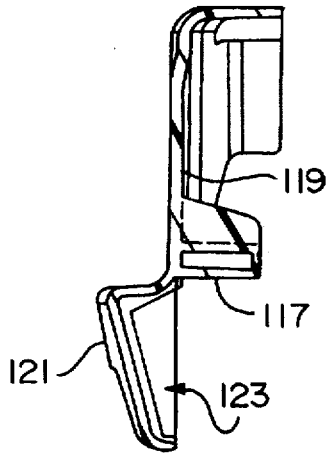
FIG. 16 is a section view taken along lines of 16—16 in FIG. 15.

As illustrated in FIG. 12, the chalkboard is generally rectangular and includes a notch 129 formed in an upper edge 131. The notch 129 is sized and configured to receive and engage both bosses 117, and is thereby retained in the recess 99. In preferred embodiments, the rod 123 is sized to fill the gap formed between the overhanging portion 121 and the front wall 98 regardless of whether the chalkboard is installed or not.

Figure 17:
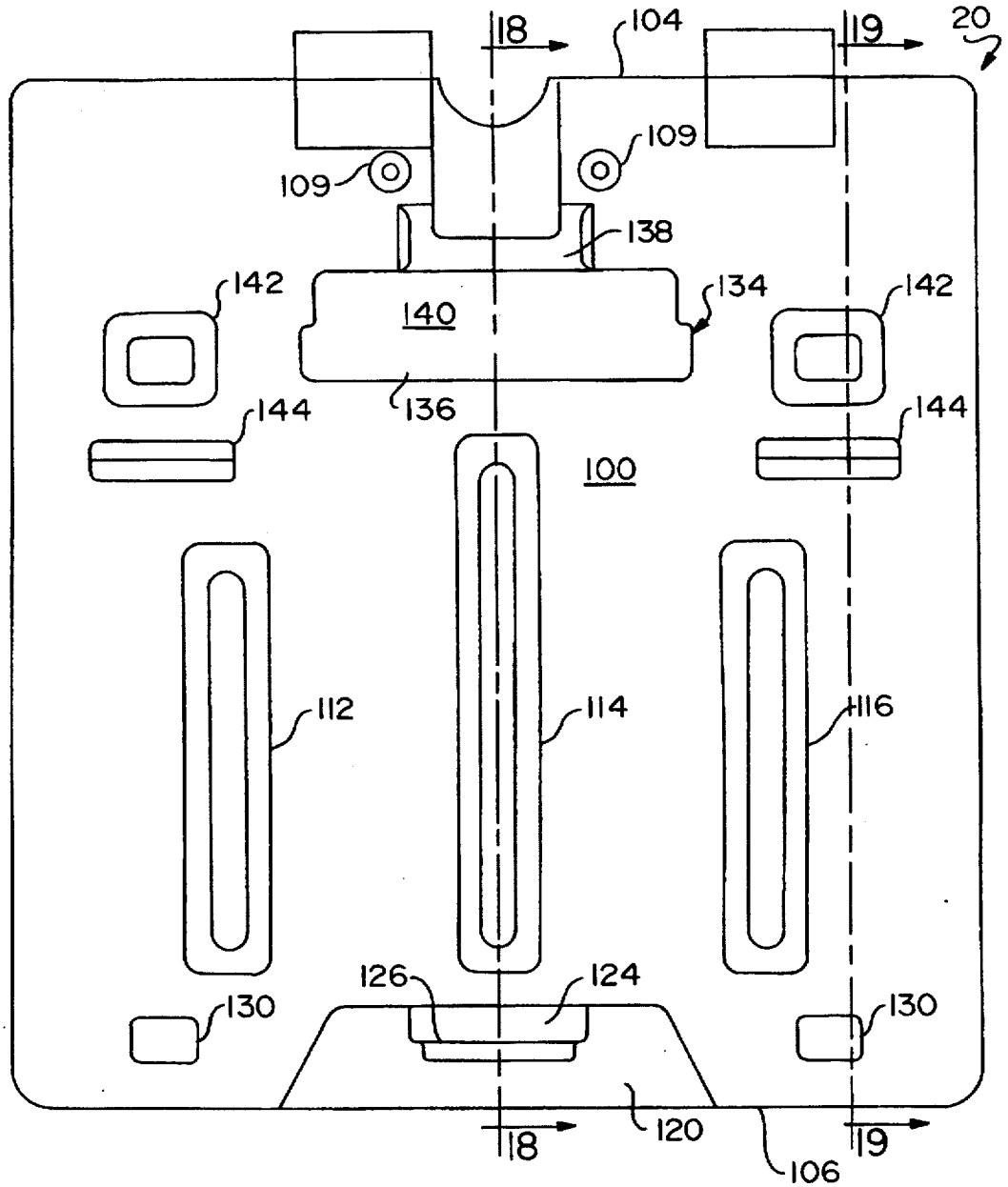
FIG. 17 is a back view of the panel of FIG. 10.

The back wall 100 includes a plurality of indentations, as shown in FIG. 17. Three parallel vertical indentations 112, 114, and 116 extend partially between the top and bottom walls 104,106 to add strength and rigidity to the panel 20. A lower central indentation 120 extends transversely adjacent the lip 110 to provide a handhold for lifting the panel 20. A lever lock-receiving indentation 124 is positioned adjacent the lower central indentation 120, being separated therefrom by a lever lock-stop bar 126. A pair of holding indentations 130 are disposed on either side of the lower central indentation 120 for lockably engaging the holding projections 51 when the panels 20 are in the easel configuration.

An upper central indentation 134 is located between the central vertical indentation 114 and the top wall 104. The upper central indentation 134 includes a larger transversely extending portion 136 for receiving a bulwark 47, when the panels 20 are in the table configuration, and a smaller transversely extending portion 138 for receiving the eliptical member 90 of the handle 24 when the panels 20 are in the easel configuration. A ramping surface 140 extends between the larger and smaller portions 136, 138 and is configured to engage the planar member 58 of the lever lock 56 when the panels 20 are in the table configuration.

A pair of indentations are located on either side of the upper central indentation 134. A holding indentation 142 is located above a ridge-receiving indentation 144 so that the holding indentation 142 receives the holding projection 51 and the ridge-receiving indentation 144 receives the ridge 33b when the panel 20 is in the table configuration.

Figure 20:
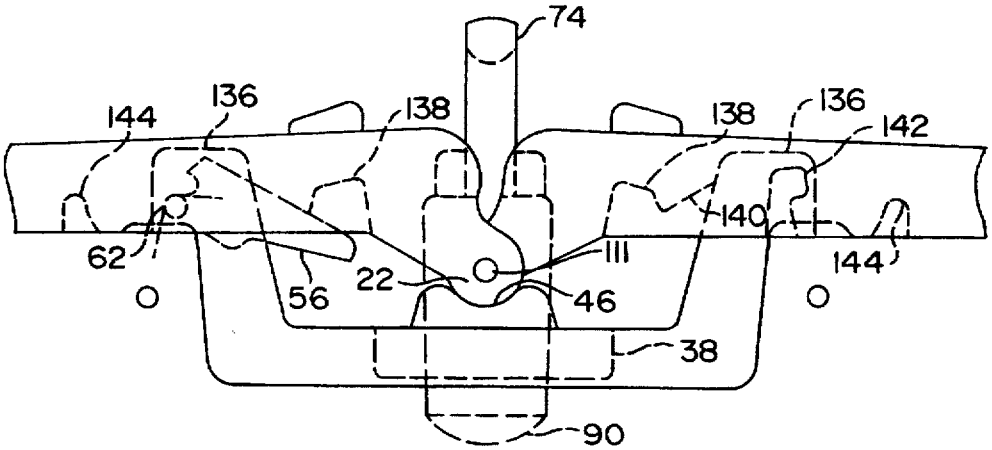
FIG. 20 is a partial front view of the article of furniture in the table configuration in a table lock down position.

FIG. 20 illustrates the interactions between the handle/panel assembly 25 and the support member 12 when the panels 20 are in the locked table configuration. In the table configuration, the hinges 22 rest in the recesses 46 and the locking portion 78 of the handle 24 is disposed in the eliptical aperture 38, with the longitudinal axis of the locking portion 78 orthogonal to the major axis of the aperture 38. The bulwarks 47 are disposed in the indentations 136, the holding projecitons 51 are disposed in the indentations 142 and the ridges 33b are disposed in the indentations 144. The locking lever 56 is held in an unlatched position by the ramping surface 140. The interactions between the bulwarks 47, projections 51 and ridges 33b with the various indentations align the panels 20, while the handle 24 locks the panels 20 in the table configuration.

Figure 22:
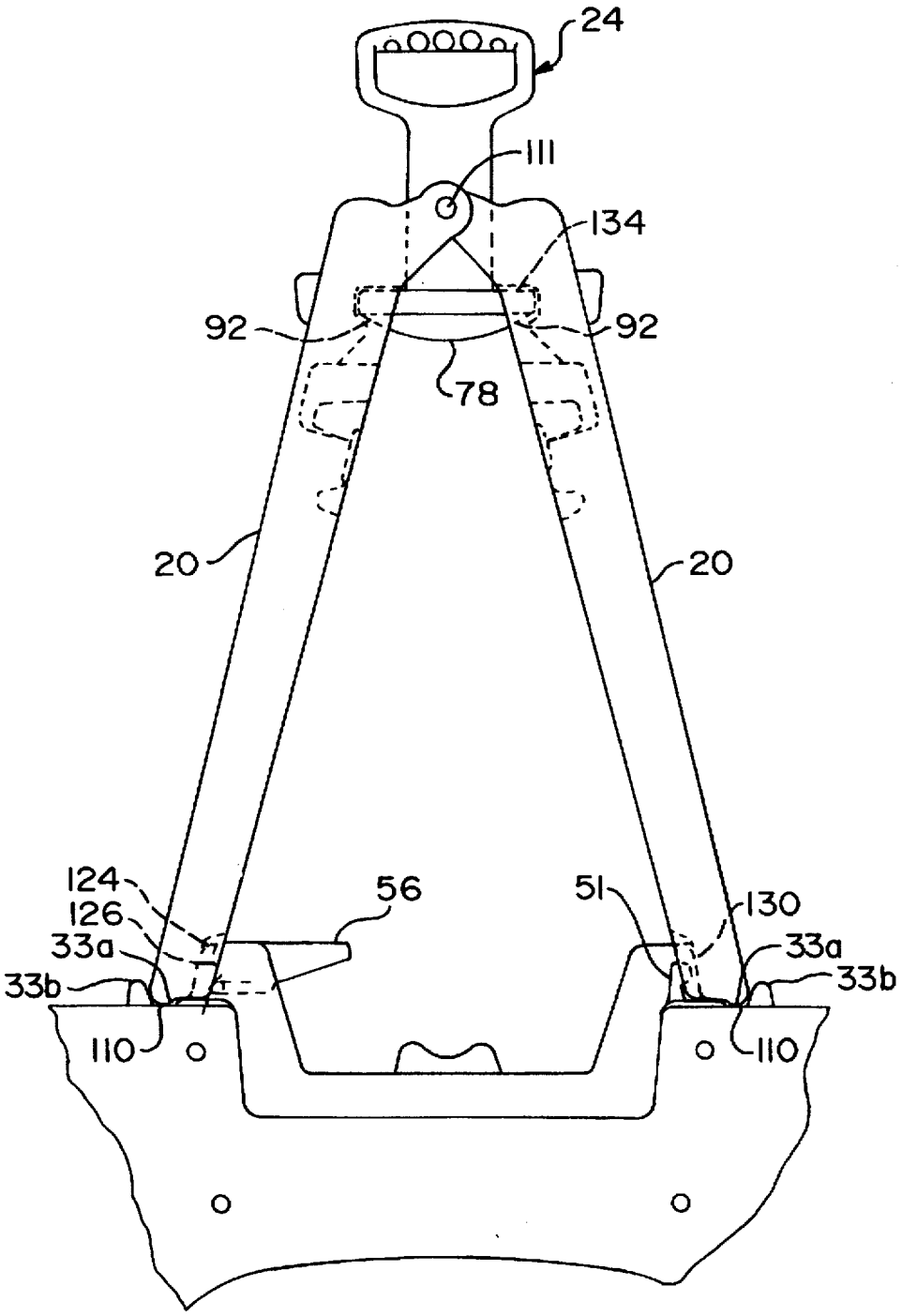
FIG. 22 is a partial front view of the article of furniture in the easel configuration in an easel lock position.

FIG. 22 illustrates the interactions between the assembly 25 and the support member 12 when the panels 20 are in the easel configuration. In the easel configuration, the handle 24 is rotated 90 degrees from the locked position of FIG. 15 so that the longitudinal axis of the locking portion 78 is parallel to the major axis of the eliptical aperture 38. In this orientation, the handle projections 92 are disposed in the indentations 134 to orient the panels 20 with a predetermined angle therebetween. The lips 110 are disposed in the grooves 33a, the holding projections 51 are disposed in the holding indentations 130, and the lever lock 56 is spring loaded into the lever lock-receiving indentation 124 with the lever lock stop bar 126 engaged by the notches 66.

Figure 21:
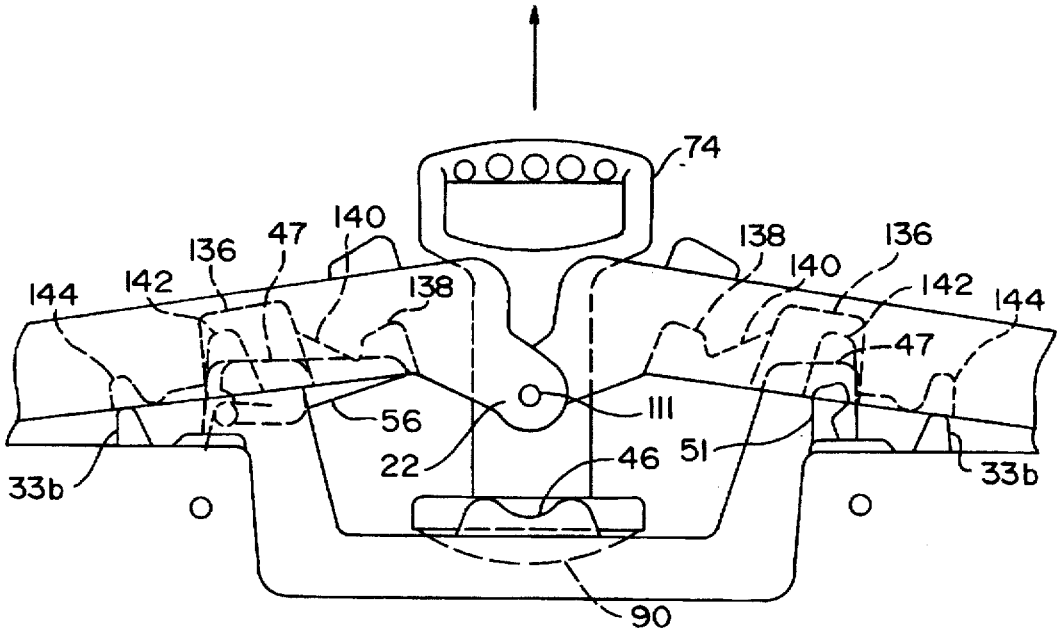
FIG. 21 is a partial front view of the article of furniture in an intermediate configuration between the table and easel configurations.

To convert the article of furniture 10 from the locked table configuration to the easel configuration, a user grasps the hand grip 74 and rotates it 90 degrees counterclockwise relative to the hinge pin 111 to unlock the panels 20 from the support member 12. Rotating the hand grip 74 aligns the locking portion 78 with the eliptical aperture 38 in the support member 12 and allows vertical movement of the handle 24, as illustrated in FIG. 21. As the user lifts the assembly 25 from the support member 12, the bottom walls 106 of the panels 20 move together, bringing the upper central indentation 134 into engagement with the locking portion 78. The engagement between the locking portion 78 and the indentation 134, as illustrated in FIG. 22, results in an A-frame type configuration with a predetermined angle subtended by the panels 20.

When the panels 20 are clear of the support member 12, the user lowers the panels 20 to position the lips 110 in the grooves 33a. Initially, the assembly 25 is tilted slightly to the right of vertical, as viewed in FIG. 22, so as to lower the right lip 110 into the right groove 33a. Once the right lip 110 is positioned, the handle 24 is rotated back to vertical, dropping the left panel 20 into the left groove 33a.

As the assembly 25 is rotated back to vertical, the holding projections 51 enter and engage the holding indentations 130 of the right panel, so that the right ridges 33b and the holding projections 51 cooperate to hold the right panel 20 in position and prevent the right lip 110 from being inadvertently knocked out of the right groove 33a. At the same time, the left lip 110 approaches the left groove 33a and the lever lock stop bar 126 cams against the camming surface 68 of the lever lock 56 to rotate the lever lock 56 about the pivot pins 62 to permit the lip 110 to pass. Once the stop bar 126 has passed the camming surface 68, the left lip 110 enters the left groove 33a and the notch 66 of the lever lock 56 engages the stop bar 126 to lock the left panel 20 in position. Thus, the holding projections 51 and the lever lock 56 cooperate to hold the assembly 25 in position on the support member 12 while the A-frame configuration of the locking portion 78 and the panels 20 help maintain the easel configuration.

To convert the invention from the easel configuration to the locked table configuration, the user pushes down on the planar member 58 to rotate the lever lock 56 about the pivot pins 62 to disengage the notches 66 from the stop bar 126 and release the lever lock 56 from the stop bar 126. Simultaneously, the user lifts the assembly 25. Since the holding projections 51 and the ridges 33b are still retaining the right panel 20 in the right groove 33, the user will have to tilt the assembly 25 away from vertical until the holding projections 51 are clear of the holding indentations 130, at which point the assembly 25 can be lifted vertically.

Once the assembly 25 is clear of the support member 12, the user spreads the panels 20 apart and rests the assembly 25 on the support member 12. This can be done using one hand, for example, by resting the right lip 110 against the leg assembly 14 and essentially rotating the handle 24 about the hinge pin 111 to raise the left panel toward the horizontal to spread the panels 20 apart. As the panels 20 open, the user directs the handle 24 toward the eliptical aperture 38 maintaining the same relative orientation between the handle 24 and the right panel 20. As the locking portion 78 of the handle 24 approaches the eliptical aperture 38, the bulwarks 47 and the holding projections 51 engage the upper central indentation 134 and the holding indentation 142, respectively, aligning the locking portion 78 with the eliptical aperture 38 and the assembly 25 with the support member 12. Once the bulwarks and projections are engaged with the panels 20, the assembly 25 drops into position in the table orientation and the user rotates the hand grip 74 clockwise 90 degrees to lock the panels 20 in place.

In preferred embodiments of the invention, the leg assemblies, panels and handle are blow molded using conventional material and techniques. The center tray, paint trays, lever locks and paper clip are injection molded with conventional methods and materials. However, it will be appreciated by those of ordinary skill in the art that other techniques, such as roto-molding, can also be used without departing from the scope of the invention.

What is claimed is:

1. An article of furniture comprising:

a support member;

a work surface, including a pair of panels hingedly connected to each other for movement between a table orientation in which said panels are approximately coplanar, and an easel orientation in which said panels are disposed in an inverted V, said article being in a table configuration when said work surface is disposed on said support member in said table orientation and being in said easel configuration when said work surface is disposed on said support member in said easel orientation and positioned against the support member in said easel orientation; and a handle coupled to the work surface and selectively engagable with said support member to lock said work surface to said support member in said table configuration.

2. The article of furniture of claim 1 further including a lock coupled to the support member and selectively engagable with said support member to lock said work surface to lock said work surface to said support member in said easel configuration.

3. The article of furniture of claim 2 wherein the work surface includes means for engaging the lever lock while in the easel configuration.

4. The article of furniture of claim 1 wherein the support member includes first aligning members for aligning the work surface in the table configuration and the work surface includes second aligning members to engage the first aligning members and inhibit lateral displacement of the work surface with respect to the support member when the article of furniture is in the table configuration.

5. The article of furniture of claim 1 wherein the support member includes a handle-receiving aperture on the upper side thereof and the handle includes a locking portion projection from the lower side of the work surface.

6. An article of furniture convertible between an easel configuration and a table configuration, the article of furniture comprising:

a support member;

a hinged work surface including a first panel and a second panel positionable on the support member in one of the easel configuration wherein the first and second panels are disposed at an angle relative to each other and the table configuration wherein the first and second panels are disposed in substantially a same plane; and a handle coupled to the work surface and selectively engageable with said support member to lock said work surface to said support member in said table configuration.

7. The article of furniture of claim 6 wherein the work surface is unlocked from the support member when the handle is in the unlocking position.

8. The article of furniture of claim 7 wherein the hinged work surface is movable between a generally planar orientation in the table configuration and an inverted V orientation in the easel configuration when the handle is in the unlocking position.

9. The article of furniture of claim 8 wherein the hinged work surface includes a pair of panels and the support member includes a pair of grooves for receiving the panels and retaining the work surface in the easel configuration.

10. The article of furniture of claim 6 wherein the handle includes a locking portion cooperating with the support member to lock the work surface in the table configuration.

11. The article of furniture of claim 6 wherein the handle includes a cylindrical shaft portion having a longitudinal axis, the shaft portion including a transverse hole and a pair of opposed slots, each slot extending in a ninety degree arc from an end of the hole in a plane orthogonal to the longitudinal axis and the hinged work surface includes a hinge pin that extends through the transverse hole, the transverse hole and the opposed slots cooperating to permit the handle to rotate about the longitudinal axis between the locking and the unlocking position.

12. The article of furniture according to claim 6, wherein the handle comprises:

a hand grip portion;

a cylindrical portion attached to the hand grip portion; and a locking portion attached to the cylindrical portion, the cylindrical portion including a first hole extending transversely therethrough and a pair of opposed slots, each of the opposed slots extending from an end of the transverse hole through a ninety degree arc.

13. A handle of claim 12 wherein the handle includes a longitudinal axis and the cylindrical portion further includes a second transverse hole orthogonal to the first hole, the pair of opposed slots extending radially outwardly from the longitudinal axis and between the transverse holes.

14. The handle of claim 12 wherein the locking portion includes a pair of opposed projections extending outwardly from the longitudinal axis.

15. The article of furniture of claim 6 wherein the support member is adapted to receive the handle.

16. The article of furniture of claim 6 wherein the first panel is pivotally connected to the second panel.

17. The article of furniture of claim 6 wherein the work surface includes an end having a tongue extending there along, the tongue engaging a groove formed in the support member to retain the work surface on the support member in the easel configuration.

18. The article of furniture of claim 12 wherein the first and second panels engage the locking portion of the handle when the work surface is in the easel configuration.

19. The article of furniture of claim 16 wherein the work surface includes a lever lock for retaining the work surface in the easel configuration.

20. The article of furniture of claim 6 wherein the first panel includes a chalkboard.

21. An article of furniture convertible between an easel configuration and a table configuration, the article of furniture comprising:

a support member;

a hinged work surface including a hinge pin positioned on the support member; and a handle coupled to the hinged work surface and being movable between a locking position and an unlocking position, the handle including a cylindrical shaft portion having a longitudinal axis, a transverse hole and a pair of opposed slots each extending in a ninety degree arc from an end of the transverse hole in a plane orthogonal to the longitudinal axis, wherein the hinge pin of the work surface extends through the transverse hole to couple the handle to the work surface and the hinge pin, transverse hole and opposed slots cooperate to permit the handle to rotate about the longitudinal axis between the locking position and the unlocking position, the hinged work surface being locked to the support member in the table configuration when the handle is in the locking position.

22. An article of furniture convertible between an easel configuration and a table configuration, the article of furniture comprising:

a support member including a pair of grooves;

a hinged work surface positioned on the support member, wherein the hinged work surface includes a pair of panels and the panels are retained in the grooves of the support member in the easel configuration; and a handle coupled to the work surface being movable between a locking position and an unlocking position, wherein when the handle is in the locking position the hinged work surface is locked to the support member in the table configuration, and when the handle is in the unlocking position the work surface is unlocked from the support member and the hinged work surface is movable between a generally planar orientation in the table configuration and an inverted V orientation in the easel configuration.

23. A method of converting an article of furniture including a hinged two-panel work surface having a handle coupled thereto supportable on a support structure between a table configuration and an easel configuration, the method comprising the steps of:

(a) positioning the panels in a substantially planar orientation wherein the panels rest on the support member to form the table configuration;

(b) engaging the handle with the support member to lock the work surface to the support member in the table configuration;

(c) moving the handle to an unlocked position disengaging the handle from the support member;

(d) moving the work surface into the easel configuration wherein the panels are disposed at an angle relative to each other; and (e) repeating any of steps (a)–(d).

24. A method of claim 23, wherein step (d) comprises lifting the handle to raise the work surface from the support member; and step (a) comprises spreading the panels into the substantially planar orientation.

25. The method of claim 23, further comprising the step of locking the panels to the support member using a locking mechanism separate from the handle in the easel configuration.

26. A method of claim 23 wherein step (b) comprises the steps of inserting an elongated portion of the handle in an elongated receiving aperture formed in the support member and rotating the handle to a locked position to lock the work surface to the support member.

27. A kit for a convertible article of children's furniture, the article of furniture being convertible between an easel configuration and a table configuration, the kit comprising:

a support member having an upper surface;

a pair of panels connected to each other by a joint for movement between a first orientation, wherein the panels are in a generally parallel relationship with respect to the upper surface, and a second orientation, wherein the panels are disposed substantially non-parallel relative to each other and at an angle relative to the upper surface, the panels being disposed on the support member in the first orientation to define the table configuration and in the second orientation to define the easel configuration; and a handle attached to the panels at the joint and selectively engageable with the support member to secure the panels to the support member in the first orientation.

* * * * *